US009589553B2

(12) United States Patent
Ulbrick

(10) Patent No.: US 9,589,553 B2
(45) Date of Patent: Mar. 7, 2017

(54) NOISE REDUCTION DEVICE

(71) Applicant: David John Ulbrick, Victoria (AU)

(72) Inventor: David John Ulbrick, Victoria (AU)

( * ) Notice: Subject to any disclaimer, the term of this patent is extended or adjusted under 35 U.S.C. 154(b) by 0 days.

(21) Appl. No.: 14/784,122

(22) PCT Filed: Apr. 10, 2014

(86) PCT No.: PCT/AU2014/050011
§ 371 (c)(1),
(2) Date: Oct. 13, 2015

(87) PCT Pub. No.: WO2014/165943
PCT Pub. Date: Oct. 16, 2014

(65) Prior Publication Data

US 2016/0055841 A1 Feb. 25, 2016

(30) Foreign Application Priority Data

Apr. 11, 2013 (AU) ..... 2013203955

(51) Int. Cl.
*G10H 3/14* (2006.01)
*G10H 3/18* (2006.01)
*G10D 1/08* (2006.01)

(52) U.S. Cl.
CPC ..... *G10H 3/181* (2013.01); *G10D 1/085* (2013.01); *G10H 3/143* (2013.01); *G10H 2220/505* (2013.01); *G10H 2220/511* (2013.01)

(58) Field of Classification Search
CPC ..... G10H 3/181; G10H 2220/511; G10H 2220/515; G10H 3/188; G10H 1/0058;
(Continued)

(56) References Cited

U.S. PATENT DOCUMENTS 2,896,491 A 7/1959 Lover
5,530,199 A 6/1996 Blucher
(Continued)

FOREIGN PATENT DOCUMENTS

AU WO 2014165943 A1 * 10/2014 ..... G10D 1/085

OTHER PUBLICATIONS

Jul. 3, 2014 Search Report issued in International Patent Application No. PCT/AU2014/050011.
(Continued)

*Primary Examiner* — Marlon Fletcher
(74) *Attorney, Agent, or Firm* — Oliff PLC; R. Brian Drozd

(57) ABSTRACT

A passive noise reduction device may be used with an instrument having at least one electromagnetic pickup. The device may include a device coil wound so as to form at least one free-shaped ring, a first terminal for connection to the pickup coil, and a second terminal for connection to ground. The device coil is responsive to the one or more stimuli so as to produce a noise electrical signal component in the device coil. The pickup coil and the device coil are in substantially the same plane. The noise reduction device coil is wound such that the pickup noise electrical signal component is substantially 180° out of phase with respect to the device noise electrical signal component, and such that the device noise electrical signal component destructively interferes with the pickup noise electrical signal component so as to reduce noise in a resultant electrical signal into the output circuit.

20 Claims, 12 Drawing Sheets

(58) Field of Classification Search
CPC ..... G10H 2220/505; G10H 2240/285; G10H 2240/115; G10H 2240/295; G10H 2240/301; G10H 3/143; G10H 3/182; G10H 3/18; G10H 3/185; G10H 3/12; G10H 3/14; G10H 1/08; G10H 2220/211
See application file for complete search history.

(56) References Cited

U.S. PATENT DOCUMENTS

| | | | | |
|---|---|---|---|---|
| 5,569,872 | A | 10/1996 | Gimpel | |
| 6,291,759 | B1 | 9/2001 | Turner | |
| 7,105,731 | B1 | 9/2006 | Riedl | |
| 7,259,318 | B2 | 8/2007 | Chiliachki | |
| 2004/0144241 | A1* | 7/2004 | Juskiewicz | G10H 1/0058 84/723 |
| 2005/0051022 | A1* | 3/2005 | Hodder | G01H 9/004 84/724 |
| 2005/0162247 | A1 | 7/2005 | Beller | |
| 2005/0204905 | A1* | 9/2005 | Chiliachki | G10H 3/181 84/728 |
| 2016/0195509 | A1* | 7/2016 | Jamieson | G01N 33/2858 356/70 |

OTHER PUBLICATIONS

Mar. 1, 2016 Search Report issued in European Patent Application No. 14783403.0.
May 27, 2016 Search Report issued in European Patent Application No. 14783403.0.

* cited by examiner

NOISE REDUCTION DEVICE

FIELD OF THE INVENTION

The present invention is related to a noise reduction device. The noise reduction device may be particularly useful for reducing noise in electric stringed instruments, such as guitars, violins and the like.

BACKGROUND OF THE INVENTION AND PRIOR ART

A common method for amplifying a sound of a stringed musical instrument, having one or more metal strings made by magnetic permeable material, uses a magnetic pickup positioned beneath the strings. When a person plays the stringed electric instrument, the stings vibrate with harmonic frequencies, which allows the pickup to sense vibration of the strings and generate an electric signal, which is then communicated to an amplifier and speaker system to generate a sound. Ideally, the sound will accurately reflect the vibration of the strings.

The pickup may include one or more coils wrapped around one or more magnetic permeable metal cores, which are themselves magnetic, or which are magnetised by an adjacent permanent magnet. The magnetic field created by this magnetic structure does not generate an electric signal inside the pickup metal coil by itself, because the magnetic field flow, flowing through the turns of the pickup coil, is constant (in absence of vibration of the strings).

Because the metal strings of the instrument are positioned near the magnetic structure of the pickup, a small area of each string becomes magnetised. This magnetised string area has a size close to the width of the exposed topside of the pickup magnet means.

In turn, the magnetised string area can radiate its own magnetic field toward the pickup. When the string is not vibrating, this magnetic field does not create an electrical signal inside the coil of the pickup. However, when the string does vibrate, for example, by being picked, strummed or bowed by a player of the instrument, the magnetised string area also vibrates and causes an alternating magnetic field to interact with the pickup, so as to cause an electric signal to pass through the coil.

The electric signal corresponds to the frequency of the strings mechanical vibration. The signal is passed through an electric circuit for amplification by an amplifier and through to a speaker system to create a human-audible sound.

Early pickup designs included a pickup designs included a pickup coil, wherein the coil was wound in a single direction, thus having a chiral characteristic. Such pickups are known in the technology as "single coil" pickups.

The term "chiral" is used in this specification and/or claims, and has its ordinary meaning, wherein an object that is chiral is not superposable onto its mirror image. A single coil winding, for example, is chiral because a right-handed wound coil is not similar to a left-handed wound coil, similarly, a clock wise wound coil is not similar to an anti-clockwise wound coil.

Whilst such single coil pickups are able to produce desirable tones, reflecting an accurate representation of the string vibrations, the single coil pickup design has a flaw, being that they are subject to also picking up much noise created by additional stimuli. These additional stimuli include external radio waves, electrical and magnetic disturbances created externally and also stimuli created within the circuitry of the electrical string instrument and/or amplifier, and other sources of electrical, magnetic or electromagnetic noise.

These additional stimuli are also detected by a pickup, which responds to the stimuli by producing noise signals within the pickup coil, similarly to the signals produced by the vibrating string or strings. The electrical signals generated in the coil by the additional stimuli may be referred to as noise signals, and the electrical signals generated in the pickup coil by the vibration of the string or strings may be referred to as musical signals.

Many different attempts have been made to solve the problem of the noise signals, which can cause unwanted distortion in the amplified sound of the stringed instrument. Previous solutions have attempted to, by various means, neutralise the noise signal, whilst preserving the musical signal. However, such previous solutions have caused secondary problems, such as alteration of the tone, timbre, or alteration of other qualities, of the musical signal, plus producing a sound which is considered not to have high fidelity.

A further problem with previous solutions is that they tend to increase output of a signal, and can therefore cause feedback problems.

Further, many, if not all of these previous noise reduction solutions have been complex, difficult and expensive to manufacture, difficult to operate and difficult to fit within the stringed musical instrument. Moreover, many, if not all of these previous noise reduction solutions are invasive to the musical instrument, which can result in a requirement to redesign the musical instrument before accommodation of such a device and its components. Furthermore, such invasive fitting or redesign of a musical instrument can result in an unpleasing aesthetic appearance, and reduction of the value of the instrument, particularly when the instrument is of great value and/or rarity.

One previous solution is described in U.S. Pat. No. 2,896,491 (S. E. LOVER). wherein a pickup 10 is provided, which is designed with two coils of wire 12, 14, wherein one coil is wound in an opposite direction to the other coil. This device also provides a bar magnet 16, which magnetises pickup magnets 18, located within their respective pickup coils 12, 14. One coil is induced by the bar magnet to have a north oriented magnetic field, the other coil is induced by the bar magnet to have a south oriented magnetic field. The coils are mounted next to each other and wired in series 24. A terminal 20 of one coil passes out to an amplification circuit, and carries the resultant signal. A terminal 22 from the other coil passes to ground.

The configuration depicted in FIG. 1 is designed to reduce noise by a 180° phase shift in the noise signal being introduced by one coil with respect to the noise signal introduced by the other coil. Unfortunately, the noise reduction device and method, as depicted in FIG. 1, also results in producing a different musical tone when compared with single coil pickups. Also, the pickup design shown in FIG. 1 has a wider magnetic field and is more complicated to manufacture than a single coil pickup. The altered tone of the musical signal emanating from such a double coil pickup is considered to be less desirable to some musicians and listeners.

FIG. 2 shows another previous solution, as disclosed in U.S. Pat. No. 6,291,759 (TURNER). This design again uses two pickups with coils wound in opposite directions (clockwise and anticlockwise), wherein one coil is stacked upon the other.

The device 30 includes coil A 32 which is wound clockwise and coil B 34, which is wound anticlockwise. The pickups include small cylindrical magnets 36. A terminal 38 from, coil A passes to signal, with another terminal 40 from coil B passing to ground. The coils 32, 34 are wired in series 42.

The solution depicted in FIG. 2, while producing a 180° phase reversal for noise cancellation or reduction, also produces a different tone, when compared with the tone produced by a single coil pickup. Similarly to the solution depicted in FIG. 1, the solution depicted in FIG. 2 is difficult to manufacture and requires un-aesthetic alteration of a musical stringed instrument. This may particularly be the situation where such a device is fitted as an after-market addition. Again, the resultant musical tone produced by the solution depicted in FIG. 2 is considered far less desirable by musicians and listeners, when compared with the tone produced by a single coil pickup.

A further previous solution was to include a "dummy coil", introduced into the pickup circuit. Such a solution is depicted in FIG. 3, as disclosed in U.S. Pat. No. 5,569,872. The dummy coil 58 for this device 50 is mounted outside the magnetic field of the single coil pickup 52. The single coil pickup magnetic field being generated by pickup magnets 54. The dummy coil feeds a signal through terminal 64, along with the signal fed through the single coil pickup terminal 62, into a differential amplifier 60. Another terminal 56 of the pickup goes to ground.

This dummy coil may be of lesser impedance to the single coil pickup, and uses an active circuit in the differential amplifier (or transistorised circuit) to amplify the noise signal generated by the dummy coil to a level which is roughly equal to the noise generated by the single coil pickup. The device relies on the differential amplifier to produce a 180° phase shifted noise signal from the dummy coil with respect to the noise signal from the pickup.

Whilst the solution depicted in FIG. 3 retains the desired single coil pickup design, such solution introduces a bulky dummy coil and associated power supply and circuitry, which is complex, expensive and difficult to manufacture and it into a musical stringed instrument. Such a design also has the attendant undesirable result of an un-aesthetically pleasing musical instrument design. Moreover, the solution depicted in FIG. 3 also changes the tonal quality of the resultant musical signal, producing a sound which is less desirable for a musician and/or listener of the musical instrument.

A fourth variant noise reduction prior art solution is depicted in FIG. 4. This solution was disclosed in U.S. Pat. No. 7,259,318 (CHILIACHKI). This device introduces a large coil of wire of low impedance (approximately 200Ω to 1000Ω) a preferred embodiment of the CHILIACHKI device is an eight inch to sixteen inch coil, placed in a routed channel, machined into the stringed musical instrument body. This device 70 requires that the coil 74 is glued into the routed channel and shielded to ground 82.

As with the previously-described prior art device, this device uses a single coil pickup 72. which is magnetised by coil magnets 76. The pickup feeds a signal through terminal 80 and through another terminal 78 is connected to a control circuit, One problem with the CHILIACHKI design is that the coil is required to be relatively large. which causes attendant problems with fitting such coil into a stringed musical instrument, where such stringed musical instrument does not necessarily have a large ready-made hollow area to contain such a large coil. As mentioned, in order to fit such a large coil, it is generally required to create a routed channel in the instrument. Of course, such routing is undesirable as it is expensive during manufacture, and can affect the tonal quality of the stringed musical instrument. Cutting such a channel into an instrument will also result in an aesthetically unpleasing appearance.

A further and very important disadvantage with the CHILIACHKI design is that it requires the large coil to be shielded from at least high frequency electromagnetic noise. Such shielding can be complicated to include with the instrument and such a noise reduction device, as well as adding expense to the manufacturer of the string instrument or the noise reduction device.

Moreover, the CHILIACHKI design requires connection to a control circuit containing resistors and capacitors. Again, where such extra circuitry must be used with such a noise reduction device, this adds expense to manufacture and such circuitry must also be placed somewhere within the stringed musical instrument, causing attendant manufacturing and aesthetic appearance problems.

It is an object of the present invention to overcome, or at least ameliorate, one or more of the above-mentioned problems in previous devices and methods. It is also another possible object of the invention to overcome, or at least ameliorate, other problems in the above-mentioned prior art, or other prior art, where such problems have not been mentioned above. Moreover, it is a further possible object of the invention to provide at least a useful alternative to previous devices and methods for noise reduction.

A possible application of the present invention is providing noise reduction of greater efficiency when compared with prior devices and/or methods, but without affecting musical qualities of an instrument, such as tone, timbre or other qualities.

Other possible applications of the present invention include providing a less-invasive, or non-invasive noise reduction device for fitting into a stringed electric instrument, either during manufacture or as a post-fitted, after-market device.

A further possible object includes providing an elegant and simple design, which may be low in cost and easy to fit.

Another possible application of the present invention is to provide a noise reduction device and/or method, which does not require replacement of existing single coil pickups.

Another possible application of the present invention is to provide a noise reduction device and/or method, which does not require placement near single coil pickups of an instrument.

It would be understood that the present invention is not to be limited by providing any one or more of the above-mentioned objects and/or applications, but that the present invention may be able to meet other objects and/or application, which have not been mentioned above.

SUMMARY OF THE INVENTION

The present invention provides a passive noise reduction device for use with an instrument having one or more strings, the instrument including at least one electromagnetic pickup including at least one coil, the pickup responsive to vibration of at least one string so as to produce a music electrical signal component in the pickup coil and responsive to one or more stimuli in addition to the string vibration so as to produce a noise electrical signal component in the pickup coil, a first terminal of the pickup coil for connection to an output circuit, a second terminal of the pickup coil for connection to the device, the noise reduction device including:

a device coil including a conductor, wherein the conductor is wound so as to form at least one free-shaped ring, a first terminal of the device coil for connection to the second terminal of the pickup coil, a second terminal of the device coil for connection to ground, the device coil responsive to the one or more stimuli so as to produce a noise electrical signal component in the device coil, wherein the conductor substantially accords with formula:

$$\frac{8\rho L}{A} = R.$$

where:

ρ is resistivity of the conductor.

L is length of the conductor.

A is cross-sectional area of the conductor, and

R is resistance of the pickup coil, wherein the pickup coil and the device coil are in substantially the same plane, and wherein the noise reduction device coil is wound such that the pickup noise electrical signal component is substantially 180° out of phase with respect to the device noise electrical signal component, and such that the device noise electrical signal component destructively interferes with the pickup noise electrical signal component so as to reduce noise in a resultant electrical signal into the output circuit.

SUMMARY OF OPTIONAL EMBODIMENTS OF THE INVENTION

In one embodiment, the conductor is copper wire.

In another embodiment, the conductor is electrically insulated. The wire may be insulated by being enamelled. However, it will be appreciated that the conductor could be formed from types of electrically conductive material, other than wire.

In one embodiment. A is approximately $8\times10^{-9}$ $m^2$, ρ is approximately $1.68\times10^{-8}$ Ω·m, and L is approximately 345 m. Through the formula, this conductor is for use with a pickup coil having resistance (R) of approximately 5.8 kΩ. It will be understood that ρ being approximately $1.68\times10^{-8}$ Ω·m corresponds with copper wire, and that.

In other embodiments, the cross-section of the conductor can be chosen in accordance with American Wire Gauge AWG). In those embodiments, the conductor may be between 34 AWG to 42 AWG wire. In some embodiments, the conductor is 38 AWG or 39 AWG wire. It will be understood that A being approximately $8\times10^{-9}$ $m^2$ corresponds with wire being about 39 AWG.

In embodiments, the conductor can be wound onto some sort of substrate, such as an adhesive film or tape. In other embodiments, the noise reduction device coil can be formed into at least one free-shaped ring, and then a film or tape can be formed around the free-shaped ring coil. In yet other embodiments, it is possible to form the noise reduction device coil by using self-bond wire.

The free-shaped ring may have a diameter of approximately 8 cm to approximately 10 cm (such diameter being measured where the ring is placed in a circular, or near-circular shape). It will be appreciated that the ring could be formed in many different sizes and shapes.

The noise reduction device coil may be wound so as to form a substantially flat cross-sectioned ring, with a width of approximately 1 cm. Alternatively, such coil can be "bunch" wound, so as to form a ring with near-circular cross-section.

In one embodiment, the noise reduction device coil, is formed by a 2 to 2.5 iteration wind. In some embodiments, the conductor impedance may equal 200Ω to 1000Ω. It will be appreciated that the iterations of wind, the length of wire, the impedance, the inductance and other properties may be selectively varied, but should be substantially in accordance with the formula.

It will be appreciated that the gauge of the wire or width of the conductor) used to form the coil in the noise reduction device will be selected in accordance with the length of wire (or length of the conductor), so as to produce a desired impedance in the device coil. For example, a 38 AWG copper wire may be used, and cut to such length to form a coil with approximately 680Ω impedance for use with a pickup coil having a resistance (or impedance, taking into account the reactance) of approximately 5.8 kΩ.

It will be recognised that a single coil pickup is a magnetic transducer, where a single or multiple magnets are placed in, or near, to a single coil of wire. The single coil pickup typically has an impedance of 3000Ω to 10000Ω. Also, typically the wire used for producing a single coil pickup is 38 AWG to 44 AWG copper wire.

In an embodiment, the device coil does not require shielding from electromagnetic noise, and is not provided with any electromagnetic shielding, such as is required in prior art noise reduction equipment. Further, in embodiments the passive noise reduction device does not include electrical components, such as a resistor, a capacitor, an amplifier, a differential amplifier, or the like, or multiples and/or combinations or such electrical components, as such electrical components are not needed. It is noted that prior art noise reduction equipment requires such electrical components for operating. In this way, the noise reduction device provides a much simpler solution to noise reduction than prior art noise reduction devices.

It will be understood by those skilled in the technology of the present invention that the noise which is picked up by a single coil pickup (the one or more additional stimuli) is largely related to the length of wire used to make the pickup, the diameter of the wire used and its shape and shielding used in the pickup. The tone produced by the pickup is influenced by the type of magnets used in the pickup, along with the size of the pickup.

In a further possible embodiment, the noise reduction device coil can be formed as a series of coils, where those coils have a sum wound length being equal to an embodiment of the coil having a single coil ring.

In yet another embodiment, the device can be configured such that two or more coils are connected electrically parallel. In such an embodiment, impedance may be lower than other embodiments.

The noise reduction device coil include terminals, which may be described as start and finish terminals. Such terminals may be formed so as to be of sufficient length to connect the noise reduction device coil with the coil of a single coil pickup in a stringed musical instrument.

The noise reduction device coil may be formed so as to readily fit into an existing cavity of a stringed musical instrument. For example, such a stringed musical instrument may have a ready-formed cavity for accommodating electrical circuitry and controls of that stringed instrument, such as potentiometers and other such tone or volume control devices. A pre-formed cavity in a stringed instrument may be of a number of different shapes and sizes. Accordingly, the noise reduction device coil can be ready-formed into the required shape for fitting into a particular known stringed instrument. Alternatively, the noise reduction device coil is provided as at least one free-shaped ring, which is flexible and can be fitted into as stringed musical instrument cavity, as required.

Whilst in most embodiments it is envisaged that the noise reduction device coil will be fitted into a cavity of the musical instrument, it should be recognised that it is also possible to fit the noise reduction device coil externally to the instrument. Of course, certain limitations must be observed, such as ensuring that the plane of the noise reduction device coil and the plane of the pickup/pickups coil/coils are substantially co-planar.

Some musical instruments may be fitted with multiple singe coil pickups. In these instruments it is possible for one or more pickups to include a coil which is wound in an opposite direction with respect to the winding or coils in one or more other pickups in the instrument. Accordingly, one embodiment of the present invention provide a noise reduction device with two coils, one of which is wound in an opposite direction to the other, so as to produce two device noise electrical signal components, one of which is 180° phase shifted with respect to the other device noise electrical signal component.

In such embodiment, with two phase-shifted noise reduction device coils, each of the device coils is connected with a respective pickup coil, wherein the device coil produces a device noise electrical signal component which is substantially 180° out of phase with respect to the pickup noise electrical signal component.

In yet another embodiment, it is possible to provide the noise reduction device which is suitable for use with high impedance pickups. In such embodiments, the noise reduction device coil is wound so as to be suitable for use with pickups having coil having an impedance of, for example, 8000Ω to 11000Ω.

In certain optional embodiments, the noise reduction device may be formed from a series of smaller coils, each of which is firmed into a free-shaped ring. In such embodiments, there may be two, three, four or more free-shaped ring coils, wired in series, so as to equal the length of an embodiment of the device having a single free-shaped ring coil. It will be appreciated that in embodiments with more than one coil, those coils may be wired in parallel. It is also envisaged that, in some embodiments, a plurality of coils could be wired in a mixture of series and parallel. In embodiments, the one of the free-shaped rings is formed to be 180° out of phase with respect to at least one other of the free-shaped rings for use with an instrument including two or more electromagnetic pickups, one of the electromagnetic pickups being wound 180° out of phase with respect to at least one other of the electromagnetic pickups, or for use with an instrument including at least one electromagnetic pickup having at least two pickup coils, one of the pickup coils being wound 180° out of phase with respect to at least one other of the pickup coils.

With such embodiments that include multiple smaller coils, it is possible to place these coils, for example, in various pre-existing cavities or spaces within an already-manufactured stringed musical instrument. In one such example, an electric guitar may have three cavities formed for locating three single coil pickups, along with another cavity for containing electrical circuitry and tone or volume control knobs. In such circumstance. the multiple free-shaped ring coils of the noise reduction device can each be placed into a respective one of these four cavities in the electric guitar. It is envisaged that each coil would be placed in its respective cavity and pressed against the sidewall of such cavity, so as to take on the shape of that cavity.

In other variations of the invention, the noise reduction device can be formed from different numbers of coils wound in one direction with an equal number of coils wound in an opposite direction, so as to provide noise reduction capability for an instrument with two single coil pickups, which pickups have coils wound in opposite directions.

In other embodiments of the invention, the terminals of the noise reduction device coil (or coils) can be marked with indicia to indicate how the noise reduction device should be fitted to the musical instrument. Such indicia may indicate which terminal should be connected in series to the pickup coil, and which terminal should be connected in series to ground. Further, where an instrument contains multiple single coil pickups, which may include coils wound in different directions, the indicia of the terminals of the noise reduction device can indicate which terminal should be electrically connected in series with which respective single coil pickup of the musical instrument, also indicating which of the terminals should be connected in series to ground. The indicia may include colours, patterns, words, symbols or combinations of two or more such indicia. The indicia may be devised so as to be used in conjunction with installation instructions.

The noise reduction device may also be wired in parallel to an optional balance potentiometer (pot). It will be recognised that such a potentiometer is merely optional and not required for effective operation of the present noise reduction device, but can be included merely to provide a means for adjusting qualities of the musical instrument.

In some electric guitars, or other stringed musical instruments, there are three single coil pickups, with the middle-located pickup having a coil which is wound in an opposite direction when compared with the direction of winding of the other two pickups (front pickup and back pickup). It is possible to provide an embodiment of the present invention so as to be suitable for use with such pickup arrangements.

In other stringed musical instruments, there are two, three or more single coil pickups which are wired in parallel. It is also possible to provide an embodiment of the present invention, which is suitable for reducing noise of each of the pickup coils in such a musical instrument.

In a further optional embodiment, the device coil is connected to the pickup coil by an electrically shielded connecting conductor, and wherein the shield is connected to ground. In such embodiment, the electrically shielded connecting conductor may comprise a coaxial conductor.

BRIEF DESCRIPTION OF THE DRAWINGS

Embodiments of the invention will now be described, by way of example only, and with reference to the accompanying drawings, in which.

DETAILED DESCRIPTION OF OPTIONAL EMBODIMENTS OF THE INVENTION

To reduce hum and noise from a single coil pickup, it may be desired to introduce a circuit/coil/antenna that can also pickup such hum and noise. It may be desirable for such a system to passively introduce a same or similar amount of noise to a single coil pickup, wherein that noise is carried by a signal which is approximately 180° out of phase with the noise signal emanating from the single coil pickup.

With this in mind, the present invention provides, in embodiments, a device which is designed to be able to remove, or at least reduce the noise from an instrument's single coil pickup or pickups, without substantially altering the tone or other musical qualities of the pickup or pickups. The present noise reduction device is wound differently, and is of a different size and impedance, when compared with other prior art devices.

The inventor has found that configuring the present noise reduction device to have an impedance value, which value varies similarly to the impedance value of a single coil pickup at various ambient temperatures, results in a noise reduction device which produces little or no perceptible audio difference to the sound quality of a single coil pickup.

The inventor has also found that the coil or coils in embodiments of the present noise reduction device produce sufficient noise electrical signal component values, such that noise generating a noise electrical signal component in a pickup coil is effectively countered, when the pickup noise electrical signal component is substantially 180 degrees out of phase with respect to the device noise electrical signal component.

In embodiments, the wire coil of the noise reduction device may be wound with 34 AWG to 42 AWG wire. The length of the wire to be coiled for the noise reduction device is such that the resulting impedance of the coil is between approximately 100Ω and 1200Ω. To accord with the formula the parameters will depend on the resistance of the pickup coil.

In embodiments, the present invention has a low reactive inductance value, typically, 0.01H to 0.04H. Configuring the noise reduction device with such a reactive inductance value causes little effect to the tone of the single coil pickup.

Figure 1:
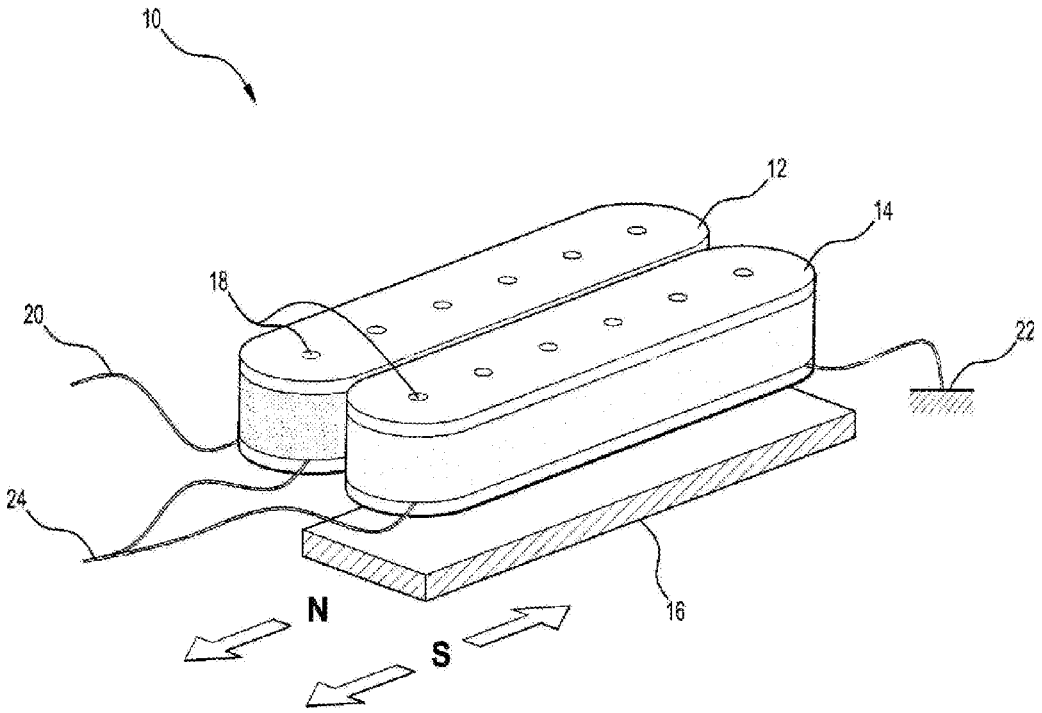
PRIOR ART FIG. 1
FIG. 1 is a perspective view of a prior art device.
Figure 2:
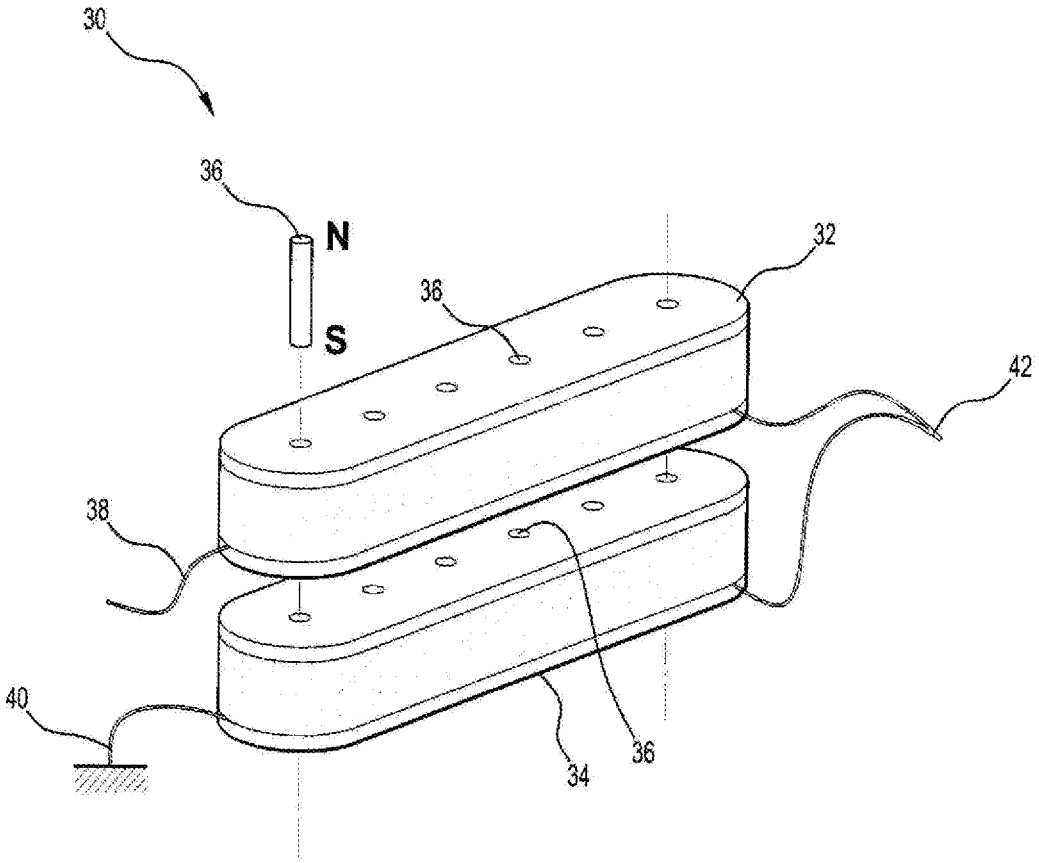
PRIOR ART FIG. 2
FIG. 2 is a perspective view of a prior art device.
Figure 3:
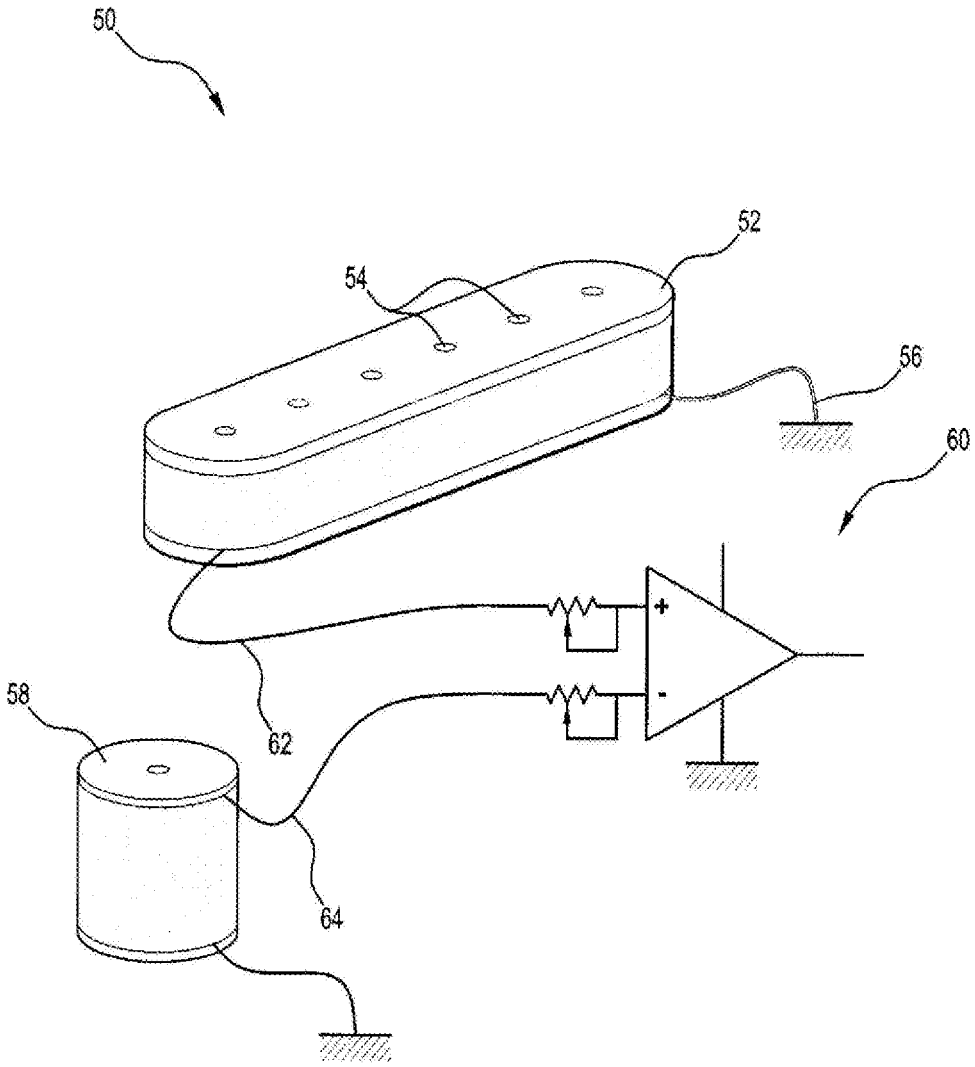
PRIOR ART FIG. 3
FIG. 3 is a perspective view of a prior art device, along with a diagrammatic representation of an electrical circuit for that device.
Figure 4:
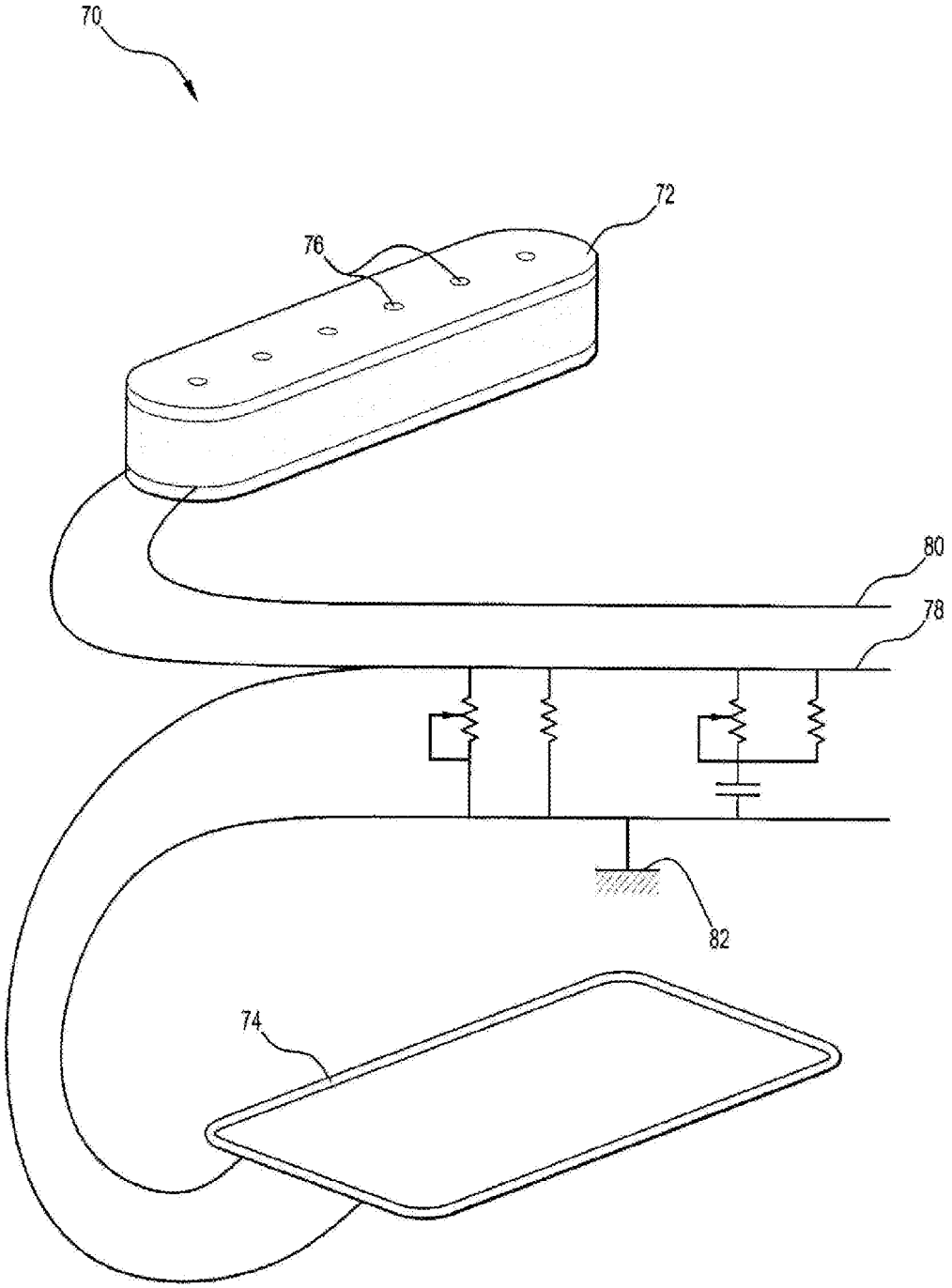
PRIOR ART FIG. 4
FIG. 4 is a perspective view of a prior art device, along with a diagrammatic representation of an electric circuit for that device.
Figure 5:
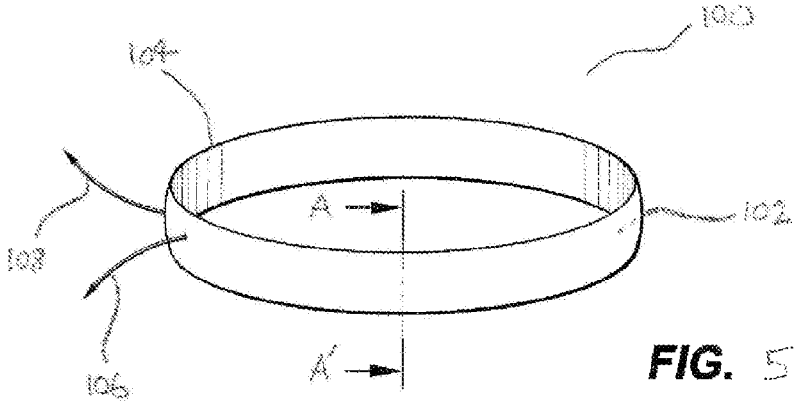
FIG. 5 is a perspective view of an embodiment of the present invention.

An embodiment of the present noise reduction device 100 is shown in FIG. 5. The device 100 includes a wire coil 102, which is wound in a particular chiral direction, that is, a left-handed winding or a right-handed winding. Alternatively, this can be called a clockwise winding or an anti-clockwise winding. The winding of the coil will be determined based on the winding of the corresponding single coil pick up to which the device 100 is connected. In order to produce a noise electrical signal component in the coil of the device which is substantially 180° out of phase with respect to the noise electrical signal component produced in the single coil pickup, the winding of the device coil would need to be in an opposite direction to the winding of the single coil pickup coil, that is, if the single coil pickup coil is wound in a clockwise direction, the device coil will be wound in an anti-clockwise direction.

The coil 102 of the device 100 has an insulating cover 104. The insulating cover may be formed from plastic or other insulating material or materials. The cover can be a preformed plastic substrate which accepts the coil wire when it is wound to form the coil, and can then be folded over the coil when wound. The cover must allow for emergence of terminals 106 and 108 for connection respectively, to the single coil pickup and to ground.

In some embodiments, the section of wire leading from the terminal 106 to the corresponding terminal of the single coil pickup may electrically shielded, for example, by a foil tube. The shield is connected to earth. This shielding can eliminate or substantially ameliorate electrical noise signals form the section of wire, but without substantially negatively affecting the tone qualities due to the device coil remaining unshielded. Similar shielding may be used for the section of wire leading from the terminal 108 to earth.

In an alternative embodiment, the cover 104 can be formed from plastic insulating tape. In such an embodiment, the coil wire can be wound, with or without a substrate, and when the coil has been wound, the tape can be wrapped helically around the wound coil. Again, the tape must allow for terminals 106 and 108 to protrude through the cover for connection.

It should also be understood that the wire coil 102 of the device 100 does not need to be covered. It is possible to form the coil 102 with, for example, copper wire, and to not use a cover. Further, it is possible to form the coil 102 using self-bond wire.

Figure 6:
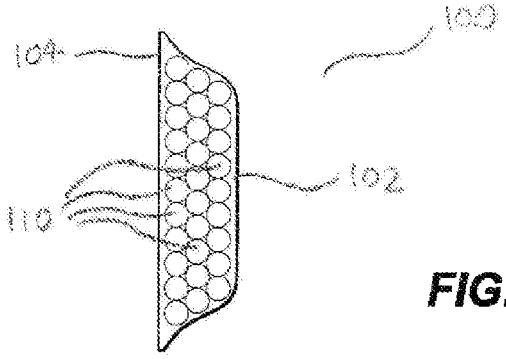
FIG. 6 is a cross-sectional view across line A-A' from FIG. 5.

FIG. 6 shows a cross-sectional view across line A-A' from FIG. 5. It can be more-clearly seen in FIG. 6 that the coil 102 of the device 100 is composed, in this embodiment, of approximately thirty loops of coil wire 110. It will be appreciated that the number of coils can be greater or lesser, depending on the desired impedance and/or inductance for the device 100, and depending on the gauge and properties of the wire used.

In FIG. 6, it can be seen that the configuration of the windings 110 of the coil 102 is relatively flat, such that the wire coil forms a free-shaped ring, which is somewhat ribbon-like. Such a cross-sectional profile for the coil 102 can be useful, if it is desired to fit the coil within a narrower cavity space in a musical instrument.

Figure 7:
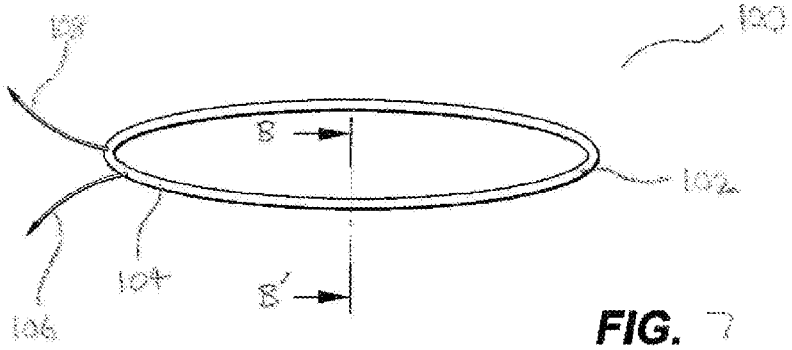
FIG. 7 is a perspective view of another embodiment of the present invention.

FIG. 7 shows an alternative embodiment of the device 100, having a coil 102, which is wound so as to have a more circular cross-sectional profile. This can be seen more clearly in FIG. 8, which is a cross-sectional view across line B-B' from FIG. 7.

Figure 8:
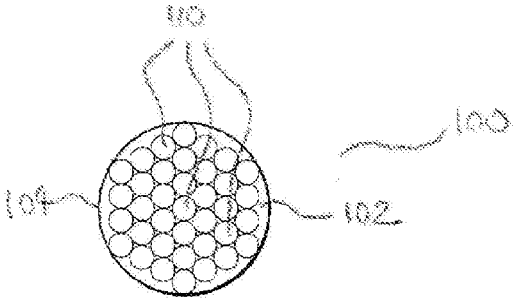
FIG. 8 is a cross-sectional view across line B-B' from FIG. 7.

This "bunch" wound configuration, as shown in FIGS. 7 and 8, may be more useful in an application where it is desired to insert the coil in a cavity space which is lower and wider, within a musical instrument.

Figure 9:
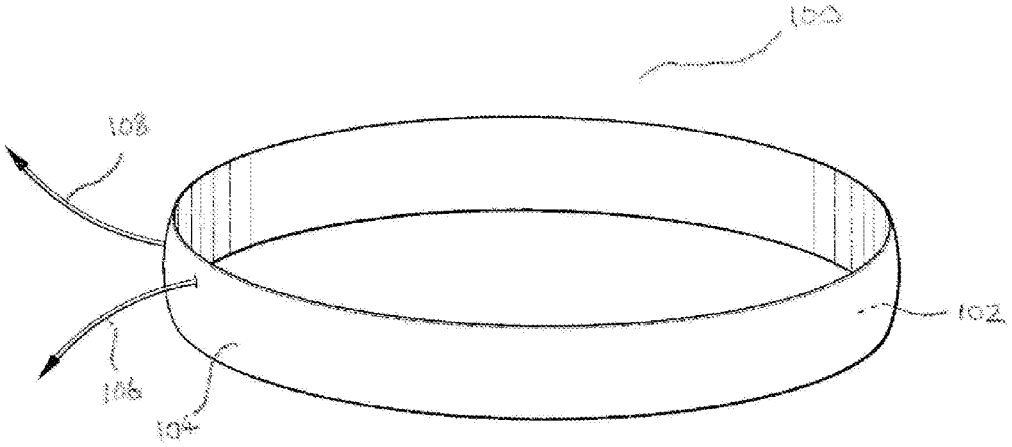
FIG. 9 is a larger perspective view of the embodiment shown in FIG. 5.

FIG. 9 shows a more-magnified view of the embodiment already shown in FIG. 5.

Figure 10:
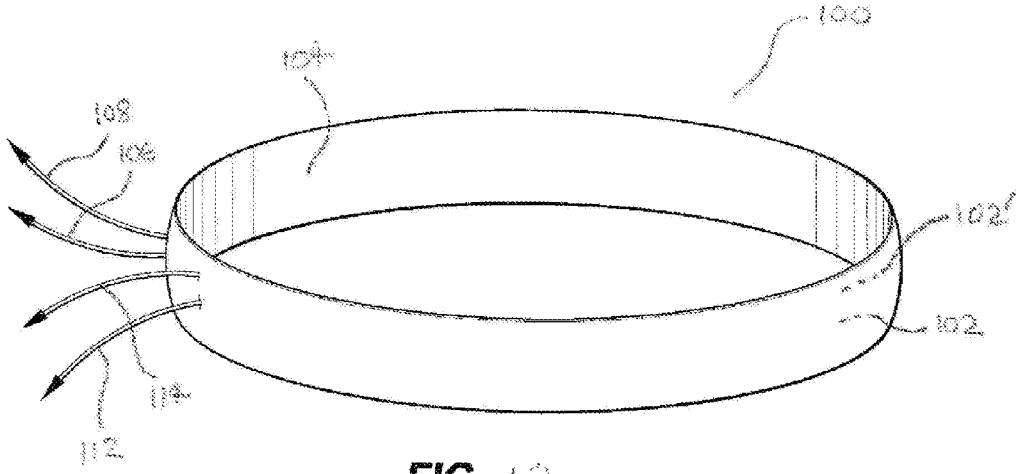
FIG. 10 is a perspective view of yet another embodiment of the present invention.

In FIG. 10 there is shown an embodiment wherein there are two coils 102, 102' in the device 100. One coil 102 is reverse wound with respect to the other coil 102'. In other words, one coil 102 may have a clockwise winding, whereas the other coil 102' has an anticlockwise winding. It will be appreciated that, in other embodiments, there may be 3, 4, 5, 6 or more coils in a single pickup.

Each coil has its respective terminals, with coil 102 having terminal 106 to a first single coil pickup, and terminal 108 to ground. Coil 102' has terminal 112 to a second single coil pickup and terminal 114 to ground. It will be appreciated that, in other embodiments, the instrument may include more than two pickups. Further, the instrument may have a mixture of single coil pickups and other types of pickups, whether or not such other types of pickups can employ the present invention.

It will be appreciated that the embodiment of the device 100, as shown in FIG. 10, would be suitable for use with an instrument having two single coil pickups, wherein a first of the two pickups includes a coil wound in one direction, whereas the second pickup includes a coil wound in an opposite direction from the coil of the first pickup.

Figure 11:
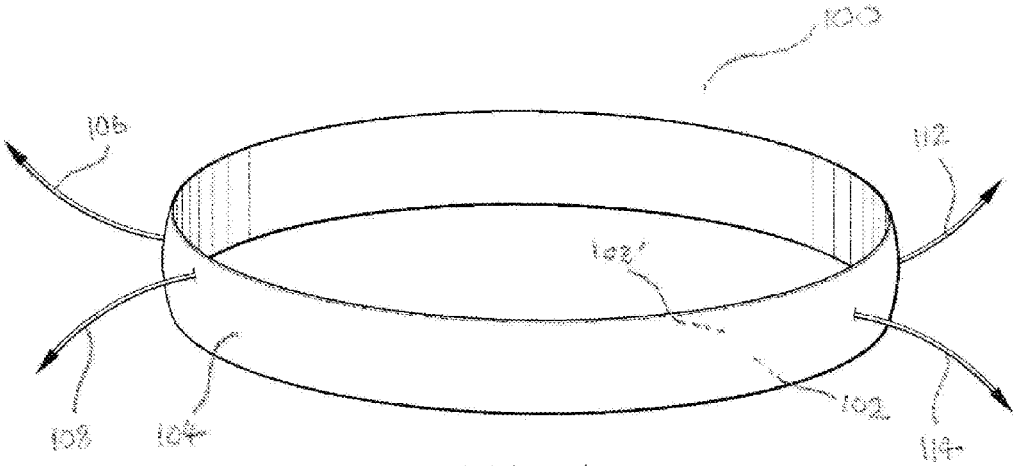
FIG. 11 is a perspective view of an alternative embodiment of the present invention.

FIG. 11 also shows a device 100 with two separate coils 102, 102'. In this embodiment, one coil 102 is wound anticlockwise, whereas the other coil 102' is wound clockwise. Terminals of the coils emanate from opposite sides of the device 100.

FIGS. 12, 13, 14, 15 and 16, each show a different embodiment of the device 100 having a single coil 102. The coil forms a free-shaped ring, which can be manipulated to form a range of shapes, which are suitable for allowing the coil to be placed within a complementary-shaped cavity within a musical instrument. It will be understood that other embodiments of the device can be formed with a fixed shape, which is pre-designed for insertion into a known shaped cavity of a particular electrical stringed instrument.

Figure 12:
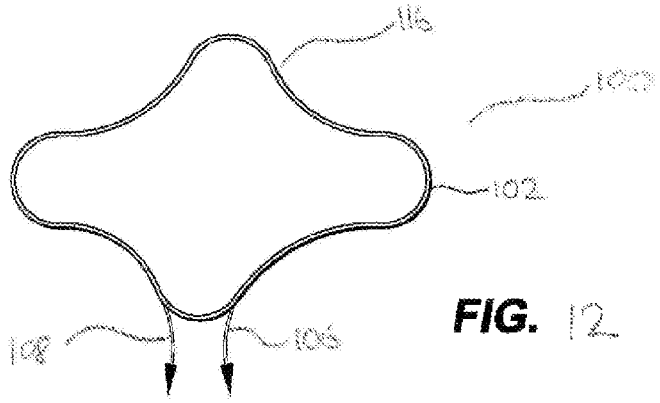
FIG. 12 is a top plan view of a first possible shape in an embodiment of the present invention.

FIG. 12 shows a "clover" shaped configuration for the free-shaped ring. This configuration may be suitable for inserting the device 100 into a cavity surrounding the electrical circuitry and control knobs (pots) of a particular electric guitar brand.

Figure 13:
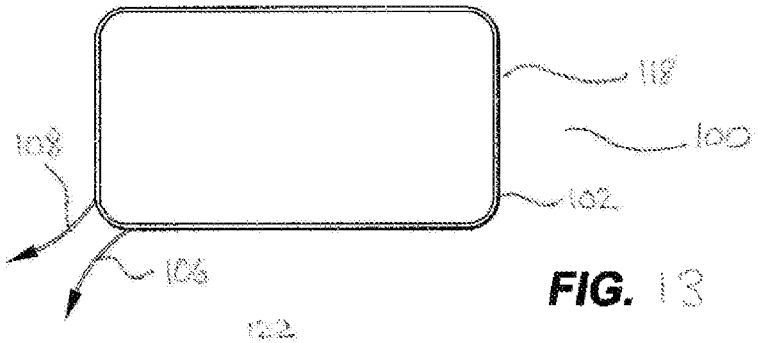
FIG. 13 is a top plan view of a second possible shape in an embodiment of the present invention.

FIG. 13 shows a coil 102 of the device 100, which has a rectangular shape 118, which will be suitable for use in a corresponding rectangular shaped cavity in a musical instrument.

Figure 14:
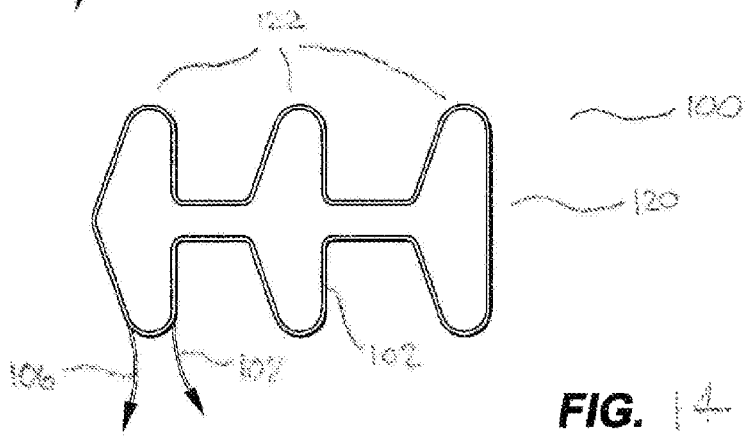
FIG. 14 is a top plan view of a third possible shape in an embodiment of the present invention.

FIG. 14 shows a configuration of the coil 102 having a shape 120 resembling a series of chevrons 122. Such a configuration may be suitable for insertion into a cavity surrounding single coil pickups in certain guitar designs.

Figure 15:
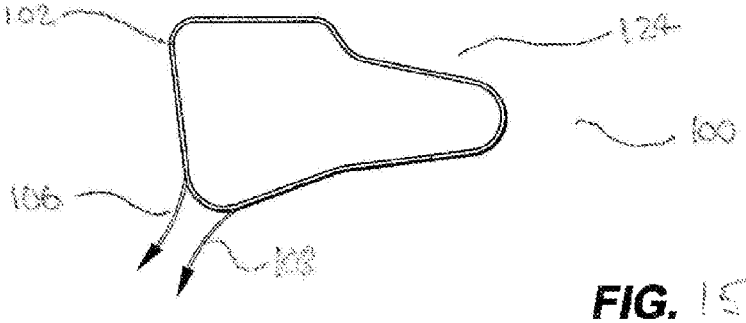
FIG. 15 is a top plan view of a fourth possible shape in an embodiment of the present invention.

FIG. 15 shows a "shoe"-shape 124 for the coil 102 of the device 100, which may be suitable for placing in a cavity containing electrical circuitry and control devices in a particular electrical guitar design.

Figure 16:
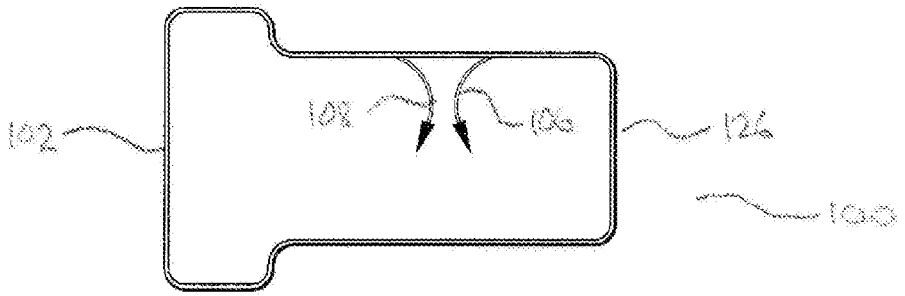
FIG. 16 is a top plan view of a fifth possible shape in an embodiment of the present invention.

FIG. 16 shows yet another embodiment of a single coil 102 for the device 100, which is a "hammer" shape 126.

Figure 17:
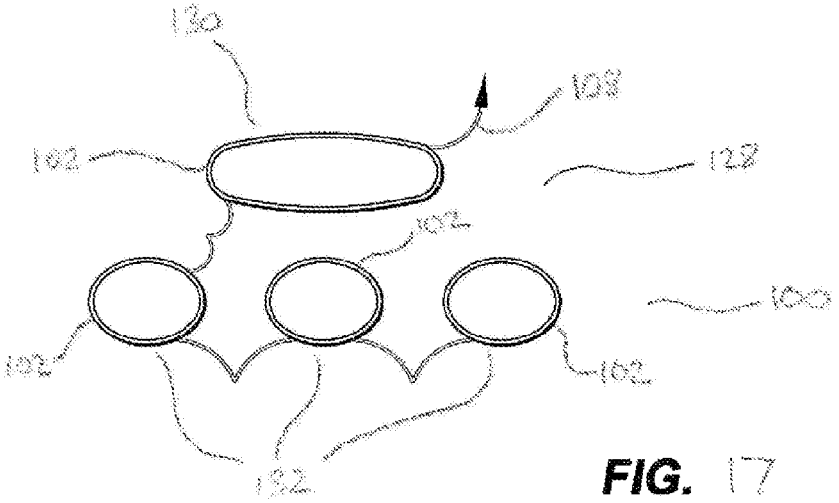
FIG. 17 is a top plan view of an embodiment of the present invention including four coils.
Figure 18:
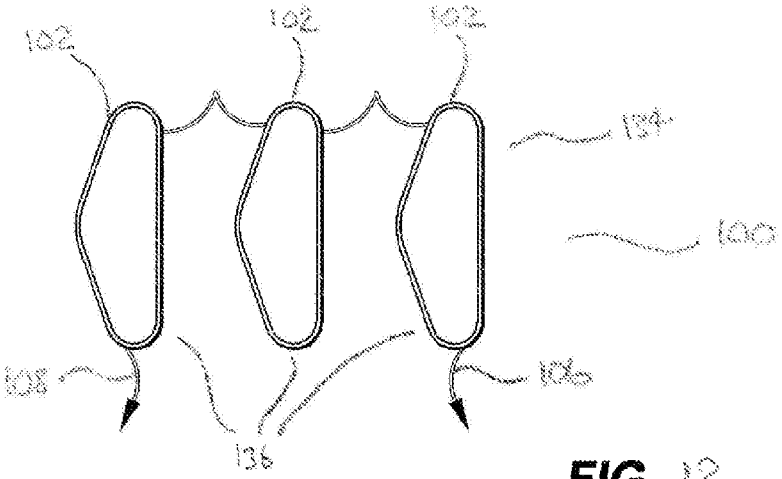
FIG. 18 is a top plan view of an embodiment of the present invention including three coils.

FIGS. 17 and 18 show various embodiments of shapes and number of coils for multi-coil designs for the device 100.

FIG. 17 shows a device 100 having a series of coils 102 with one major coil 130 and three minor coils 132. The configuration of the coils into this particular shape 128 can be useful for inserting such coils in different cavities in the body of a stringed musical instrument.

FIG. 18 is also a series of coils 102 including three chevron-shaped coils 136, which form a configuration 134 suitable for placement within cavities of a musical instrument.

Figure 19:
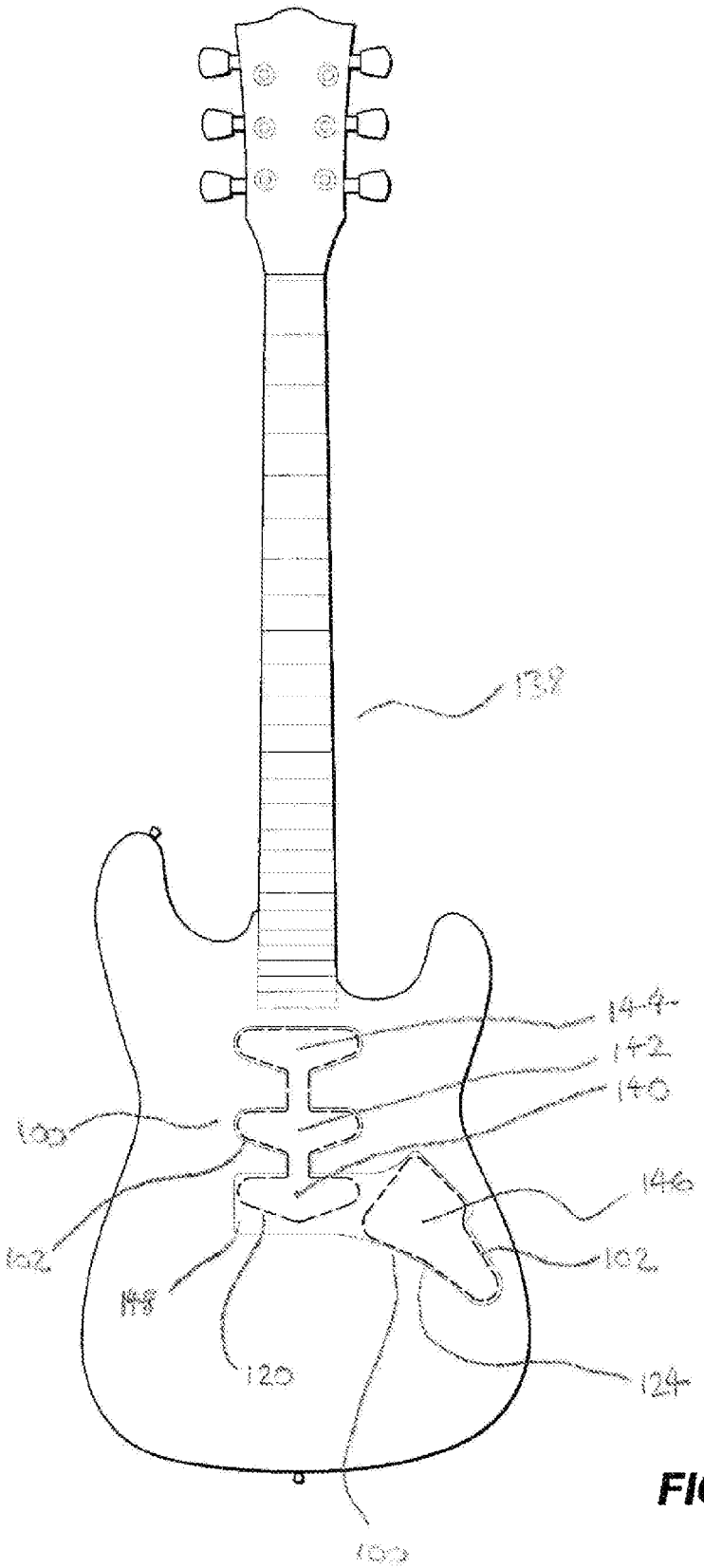
FIG. 19 is a top plan view of a guitar showing two alternative embodiments of the present invention in situ.

FIG. 19 shows an example application of the noise reduction device 100 within an electric guitar 138. The guitar includes three single coil pickups, including a front pickup 140, a middle pickup 142 and a back pickup 144. The guitar also includes electrical circuitry and control knobs (pots) 146.

In this particular guitar 138, the pickups 140, 142 and 144, along with the circuitry and control knobs 146, are all located within the one cavity space 148.

FIG. 19 shows that it is possible to fit two differently shaped configurations of the device 100 within the cavity space 148. A first configuration, similar to the configuration shown in FIG. 14, can be placed around the pickups. Another configuration of the device, similar to that shown in FIG. 15, can be placed within the cavity space 148 surrounding the control circuitry and knobs 146.

In some applications, it is conceivable that both configurations 120 and 124 of the device 100 may be desired for use within the one electric guitar 138.

Figure 20:
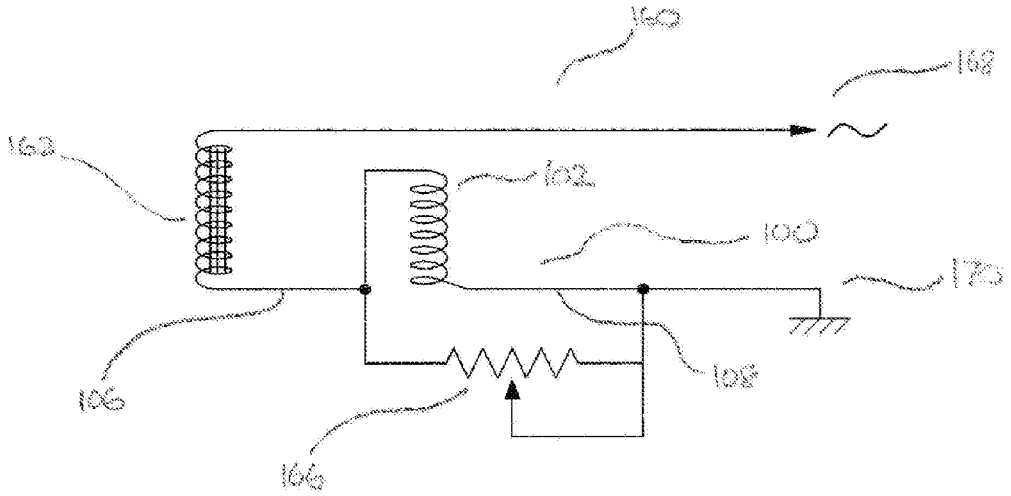
FIG. 20 is a circuit diagram showing an optional embodiment of the present invention, including a potentiometer.

FIG. 20 is a circuit diagram 160 showing the device 100 connected in series, via terminal 106, to a single coil pickup 162. The single coil pickup is then connected in series to a signal output 168. The device coil 102 is connected in series via terminal 108 to around 170.

The circuit diagram 160 shows that the device 100 may be provided with an optional balance pot or potentiometer 166. The potentiometer is not required for effective noise reduction produced by the device 100, but can be used to provide favourable tonal qualities to the music signal.

Figure 21:
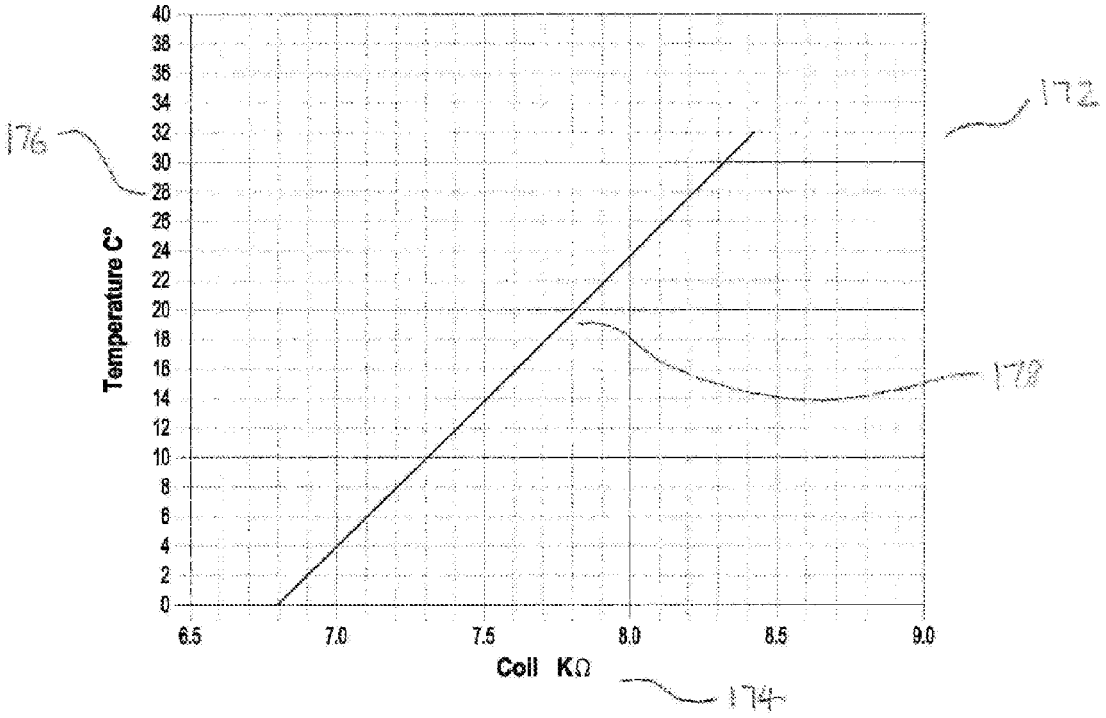
FIG. 21 is a graph showing a projected line of results based on a plurality of measurements for impedance of a single coil pickup at variable ambient temperatures.

FIG. 21 shows a graph 172 having a Y-axis indicating temperature variance from 0° C. to 40° C., along with an X-axis showing impedance in kΩ in a range from 6.5 kΩ to 9.0 kΩ. The graph 172 is an indication of variance in impedance in the coil of a single coil pickup at various ambient temperatures.

The projected results line 178 in the graph 172 was produced using actual measurements of impedance of a single coil pickup at 0° C., 18° C. and 32° C. As can be seen from the projected line 178, there appears to be a linear relationship between ambient temperature and the expected impedance of a single coil pickup.

It has been discovered that the coil 102 in the device 100 can be configured so as to produce an impedance which varies with temperature similarly to how the impedance in a given single coil pickup will vary with the same temperature. It should be emphasized that the quantum of impedance in the single coil pickup and the coil of the noise reduction device is not necessarily the same, but the change in impedance at given temperatures is sufficiently similar.

Figure 22:
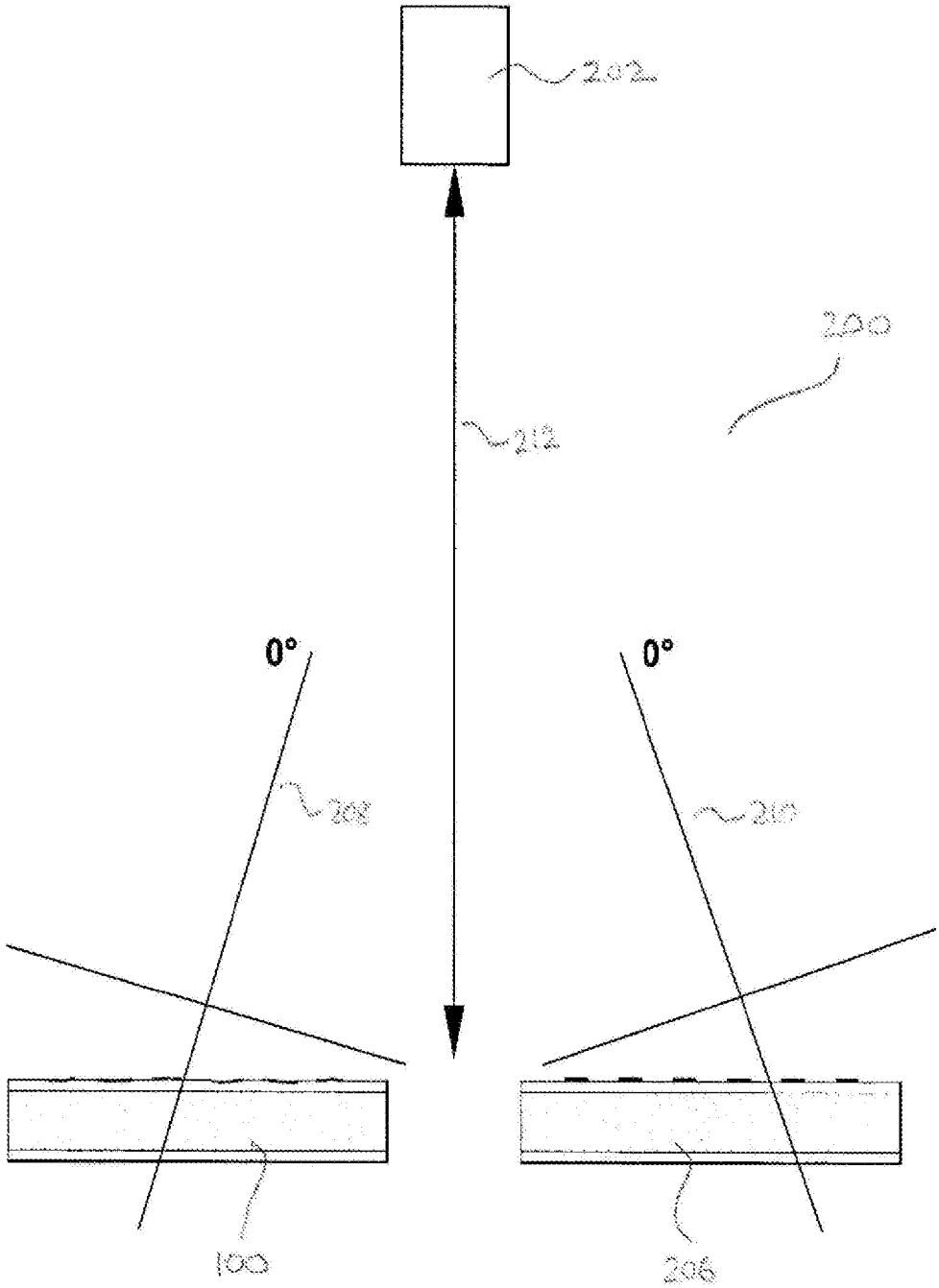
FIG. 22 is a representation of an experimental setup for assessing the noise reduction device.

FIG. 22 shows a diagrammatic representation of a setup 200 for assessing the noise reduction device 100 when used with a single coil pickup 206. The pickup used for this example assessment is a Fender® 62 re-issue single coil pickup with an impedance of 5.6 kΩ.

The noise reduction device 100 and the single coil pickup 206 are shown lying in a single plane, as would be the case with many embodiments of the invention, where the noise reduction device is situated in, for example, a guitar. For this example setup, the noise reduction device coil is formed from #38AWG wire in a coil of the wire at 680Ω impedance.

A noise source 202 is placed at a distance of one meter away from the centre point between the noise reduction device and the single coil pickup. It will be understood that the noise source 202 is situated perpendicular to the plane of the noise reduction device and the single pickup coil, with the signal noise from the source transmitting along line 212, and propagating symmetrically outward from line 212 towards the noise reduction device and the single pickup coil.

Axes 208 show the direction of propagation of electromagnetic waves from the noise source 202, along the zero degree axis. Similarly, axes 210 show the direction of propagation of electromagnetic waves towards the single pickup coil 206, along the 0° axis.

In this setup 200, the noise signals introduced into the single coil pickup 206 and into the noise reduction device 100 are separately measured as peak-to-peak voltage (Vpp). The Vpp is measured in graduated degrees of offset from the 0° axis, wherein the offset is measured in 10° incremental steps.

Figure 23:
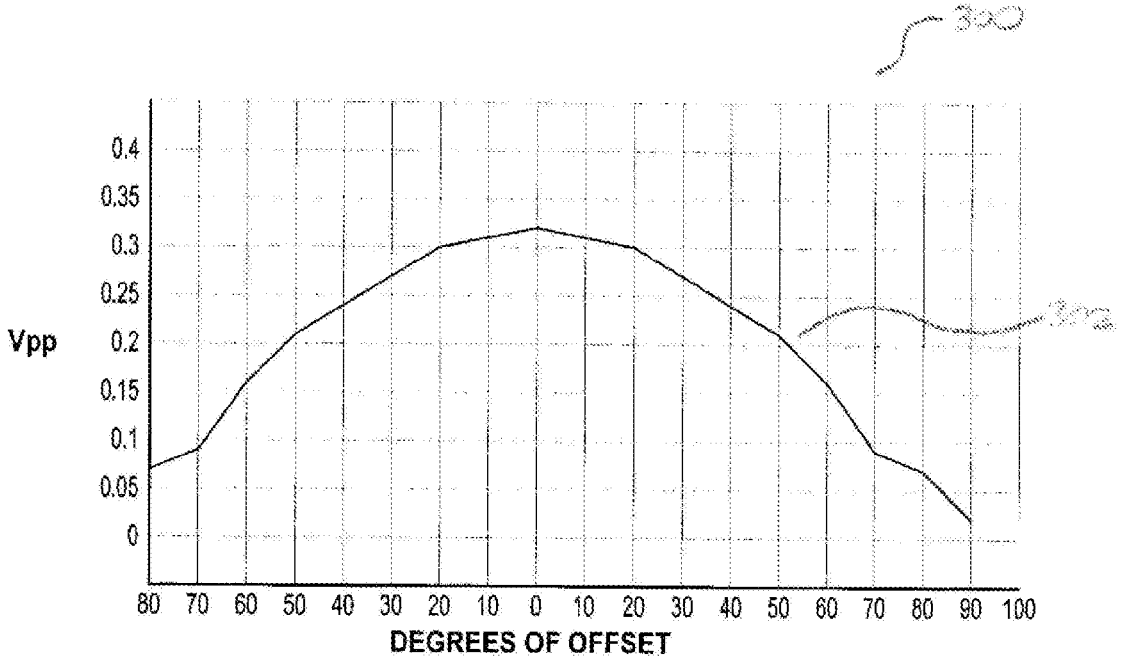
FIG. 23 is a graph showing partial results of an assessment using the setup shown in FIG. 22; and, FIG. 24 is a graph showing partial results of an assessment using the setup in FIG. 22.
Figure 24:
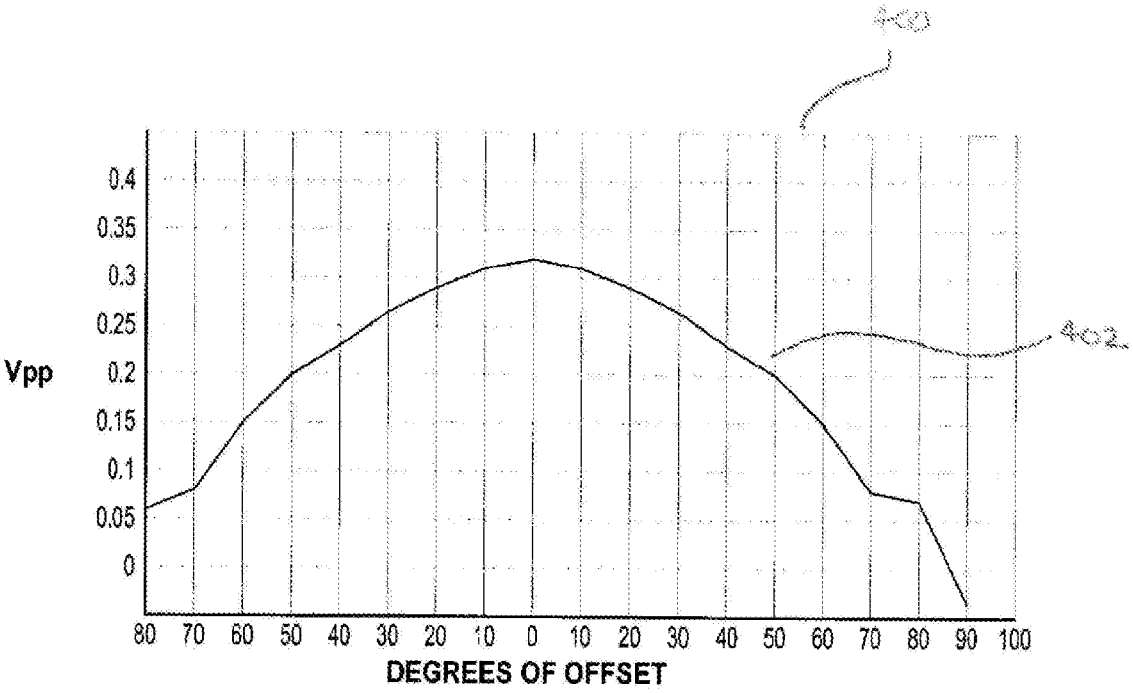

FIGS. 23 and 24, respectively, show the results from an assessment using the setup 200 shown in FIG. 22 for the single coil pickup 206 and the noise reduction device 100.

FIG. 23 shows the graph 300 for Vpp/degrees of offset in the single coil pickup 206. The plotted line 302 traces through the Vpp at each 10° increment, from 80° offset to 90° offset about the 0° axis in axes 210.

FIG. 24 shows graph 400 of Vpp/degrees of offset for the noise reduction device 100, with line 402 being plotted through the result point of Vpp at each 10° increment from 80° to 90° about the 0° axis on axes 208.

The noise source 202 in FIG. 22 is generating a 50 Hz noise signal. The noise signal is amplified by a factor of 20 by an amplifier (not shown).

The assessment using the setup 200 shows that noise introduced into the single coil pickup 206 and the noise reduction device 100 are very similar. The profiles of the plotted lines 302 and 402 demonstrate this quite clearly. Accordingly, the noise reduction device will result in noise reduction where that device 100 is placed in series with the single coil pickup 206 and 180° out of phase (50 Hz signal).

It will be understood that an assessment could be made with different sorts of setup, which are variations of the setup 200 shown in FIG. 22. For example, the noise source 202 could be at a different distance from the noise reduction device 100 and single coil pickup 206. the frequency of the signal could be different from that producing the results shown in FIGS. 23 and 24. Many other variations are also possible.

In one example embodiment, ρ is approximately $1.68\times10^{-8}$ Ω·m (for copper wire); L is approximately 345 meters; A is approximately $8\times10^{-9}$ m2; leading to R being approximately 5.81 kΩ.

It has been found that when using a single coil pickup having approximately 5.8 kΩ resistance and a coil wound with copper wire of 44 AWG, the best tones qualities of the device occur when the cross-sectional area, A, of the conductor in the device coil is chosen to be consistent with 38 AWG or 39 AWG. The tone drops in quality when larger or smaller diameter wire is used in the device coil.

Passive, noise reduction is desirable where background noise is an issue for electromagnetic pickup device within stringed musical instruments. Further it is desirable to reduce noise without changing the original timbre or tone of a single coil pickup.

The noise reduction device may also be used in other applications where background noise may be an issue. Such further applications include, for example, imaging, scanning or scientific research machinery and/or instruments, where such machinery and/or instruments require passive noise reduction.

The present invention may be implemented according to any one or more of the above-mentioned embodiments. It will also be recognised by a person skilled in the art that other embodiments are possible, and should be considered to fall within the scope of the claimed invention.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not and should not be taken as an acknowledgement or any form of suggestion that the prior art forms part of the common general knowledge.

The invention claimed is:

1. A passive noise reduction device for use with an instrument having one or more strings, the instrument including at least one electromagnetic pickup including at least one coil, the pickup responsive to vibration of at least one string so as to produce a music electrical signal component in the pickup coil and responsive to one or more stimuli in addition to the string vibration so as to produce a noise electrical signal component in the pickup coil, a first terminal of the pickup coil for connection to an output circuit, a second terminal of the pickup coil for connection to the device, the noise reduction device including:

a device coil including a conductor, wherein the conductor is wound so as to form at least one free-shaped ring, a first terminal of the device coil for connection to the second terminal of the pickup coil, a second terminal of the device coil for connection to ground, the device coil responsive to the one or more stimuli so as to produce a noise electrical signal component in the device coil, wherein the conductor substantially accords with formula:

$$\frac{8\rho L}{A} = R,$$

where:

ρ is resistivity of the conductor,

L is length of the conductor,

A is cross-sectional area of the conductor, and

R is resistance of the pickup coil, wherein the pickup coil and the device coil are in substantially the same plane, and wherein the noise reduction device coil is wound such that the pickup noise electrical signal component is substantially 180° out of phase with respect to the device noise electrical signal component, and such that the device noise electrical signal component destructively interferes with the pickup noise electrical signal component so as to reduce noise in a resultant electrical signal into the output circuit.

2. A passive noise reduction device according to claim 1, wherein the conductor is copper wire.

3. A passive noise reduction device according to claim 1, wherein the conductor is electrically insulated.

4. A passive noise reduction device according to claim 1, wherein A is approximately $8 \times 10^{-9}$ $m^2$, ρ is approximately $1.68 \times 10^{-8}\Omega m$, and L is approximately 345 m.

5. A passive noise reduction device according to claim 1, wherein the conductor is 34 American Wire Gauge (AWG) to 42 AWG wire.

6. A passive noise reduction device according to claim 1, wherein the conductor is 38 AWG or 39 AWG wire.

7. A passive noise reduction device according to claim 1, wherein the conductor is about 15 meters to about 400 meters long.

8. A passive noise reduction device according to claim 1, wherein the conductor has impedance of about 200 Ω to 1000 Ω.

9. A passive noise reduction device according to claim 1, wherein the conductor is wound onto a substrate.

10. A passive noise reduction device according to claim 9, wherein the substrate is an adhesive film or tape.

11. A passive noise reduction device according to claim 1, wherein the device coil is electrically insulated.

12. A passive noise reduction device according to claim 1, wherein the free-shaped ring has a diameter of approximately 8 cm to approximately 10 cm, when placed in a substantially circular shape.

13. A passive noise reduction device according to claim 1, wherein the free-shaped ring is wound to form a substantially flat cross-sectioned ring.

14. A passive noise reduction device according to claim 1, wherein the free-shaped ring has a cross-sectional width of approximately 1 cm.

15. A passive noise reduction device according to claim 1, wherein the device coil includes two or more free-shaped rings.

16. A passive noise reduction device according to claim 15, wherein the one of the free-shaped rings is formed to be 180° out of phase with respect to at least one other of the free-shaped rings for use with an instrument including two or more electromagnetic pickups, one of the electromagnetic pickups being wound 180° out of phase with respect to at least one other of the electromagnetic pickups, or for use with an instrument including at least one electromagnetic pickup having at least two pickup coils, one of the pickup coils being wound 180° out of phase with respect to at least one other of the pickup coils.

17. A passive noise reduction device according to claim 1, wherein the device coil is connected to the pickup coil by an electrically shielded connecting conductor, and wherein the shield is connected to ground.

18. A passive noise reduction device according to claim 17, wherein the electrically shielded connecting conductor comprises a coaxial conductor.

19. A passive noise reduction device according to claim 1, wherein the device coil does not require shielding from electromagnetic noise.

20. A passive noise reduction device according to claim 1, wherein the noise reduction device does not require further electrical components, such as: a resistor, a capacitor, an amplifier, a differential amplifier, or the like, or multiples and/or combinations of such electrical components.

* * * * *